US006687333B2

(12) United States Patent
Carroll et al.

(10) Patent No.: US 6,687,333 B2
(45) Date of Patent: Feb. 3, 2004

(54) SYSTEM AND METHOD FOR PRODUCING PULSED MONOCHROMATIC X-RAYS

(75) Inventors: Frank E. Carroll, Nashville, TN (US); Robert H. Traeger, Nashville, TN (US); Marcus H. Mendenhall, Nashville, TN (US); James W. Waters, Nashville, TN (US); Glenn Edwards, Chapel Hill, NC (US); Charles A. Brau, Nashville, TN (US)

(73) Assignee: Vanderbilt University, Nashville, TN (US)

( * ) Notice: Subject to any disclaimer, the term of this patent is extended or adjusted under 35 U.S.C. 154(b) by 128 days.

(21) Appl. No.: 09/964,872

(22) Filed: Sep. 28, 2001

(65) Prior Publication Data

US 2002/0057760 A1 May 16, 2002

Related U.S. Application Data

(63) Continuation-in-part of application No. 09/488,898, filed on Jan. 21, 2000, now Pat. No. 6,332,017.

(60) Provisional application No. 60/117,114, filed on Jan. 25, 1999.

(51) Int. Cl.[7] ..... G21G 4/00

(52) U.S. Cl. ..... 378/119; 378/138

(58) Field of Search ..... 378/119, 138, 378/137, 121

(56) References Cited

U.S. PATENT DOCUMENTS 5,247,562 A * 9/1993 Steinbach ..... 378/119
6,332,017 B1 * 12/2001 Carroll et al. ..... 378/119
6,459,766 B1 * 10/2002 Srinivasan-Rao ..... 378/119

* cited by examiner

*Primary Examiner*—Louis Arana
(74) *Attorney, Agent, or Firm*—Cooley Godward, LLP

(57) ABSTRACT

A system for generating tunable pulsed monochromatic X-rays includes a tabletop laser emitting a light beam that is counter-propagated against an electron beam produced by a linear accelerator. X-ray photon pulses are generated by inverse Compton scattering that occurs as a consequence of the "collision" that occurs between the electron beam and IR photons generated by the laser. The system uses a novel pulse structure comprising, for example, a single micro-pulse. In this way, pulses of very short X-rays are generated that are controllable on an individual basis with respect to their frequency, energy level, "direction," and duration.

17 Claims, 7 Drawing Sheets

PRIOR ART

SYSTEM AND METHOD FOR PRODUCING PULSED MONOCHROMATIC X-RAYS

This application claims priority under 37 CFR § 120 and is a Continuation-in-Part (CIP) of U.S. Application Ser. No. 09/488,898, filed Jan. 21, 2000, now U.S. Pat. No. 6,332,017, which claims the benefit of U.S. Provisional Application No. 60/117.114. filed Jan. 25. 1999. The entire disclosure of U.S. Application Ser. No. 09/488,898 is hereby incorporated by reference. This invention was made with government support under grant N00014-94-1-1023 awarded by the Office of Naval Research. The government may have certain rights in the invention.

BACKGROUND OF THE INVENTION

This invention relates to systems and methods for generating pulsed, tunable, monochromatic X-rays. More particularly, this invention pertains to systems for generating pulsed, tunable, monochromatic X-rays with high flux and in a configuration useful both for medical imaging and therapeutics and as a research instrument in the biological, biomedical, and materials sciences.

The characteristics of some X-ray beams are potentially such that they can be used in standard geometry monochromatic imaging, CT-like images of the breast using a rotating mosaic crystal "optic" time-of-flight "imaging," and phase contrast images. However, X-ray absorption imaging as currently practiced utilizes only a small part of the information amassed by an X-ray beam traversing a patient. For example, assessing damage to limbs and body cavities in severe trauma by appraising the disruption of fascial planes, and visualizing devitalized tissues, extravasated "blood," or imbedded non-opaque foreign materials is very difficult or sometimes impossible with standard X-rays or computerized tomography (CT). The same is true when one wishes to evaluate the patency of arteries and veins, non-invasively and without the use of dangerous contrast agents. Potentially, a great deal more information could be extracted during an examination, if a more versatile monochromatic X-ray beam/detector combination were available for use. Similarly, the early detection of abnormalities such as tumors, fatty replacement, or scarring in other organs such as the breast or lung is problematic at best using conventional imaging techniques and equipment.

Currently, standard X-ray tubes deliver a much broader spectrum of radiation than what is either needed or desired to make an image. Pulsed, "tunable," monochromatic X-rays would allow one to select a photon energy best suited to the imaging task at hand. For example, the frequency that would be optimal to image a breast is very different from the frequency needed to image a chest or the brain.

Monochromatic X-ray imaging can simultaneously reduce the radiation dose to a patient and reduce scattered radiation from high energy photons not needed for the image in the first place. This can be useful in several ways. Cancerous breast tissues, for example, exhibit higher linear attenuation characteristics than do normal tissues, when studied with monochromatic X-rays. This property can be exploited to improve the sensitivity and specificity of breast imaging in a number of ways. The ability to alter the geometry of an X-ray beam would make it ideal for imaging in humans as well as in materials science, molecular biology and cell biology. Standard geometry monochromatic imaging, CT imaging using new X-ray optics made from mosaic crystals, phase contrast imaging, and time-of-flight imaging are just a few examples of the potential applications for such a system.

Conventional medical X-ray equipment has not employed short pulse structures in X-ray generation. Consequently, conventional X-ray equipment continues to generate unneeded background radiation, requiring the use of shielding that substantially increases the size of the equipment. Although pulsed soft X-rays have been used in photolithography for manufacturing integrated circuits, there has been no similar use in imaging applications or in the production of hard X-rays.

Production of pulsed, nearly monochromatic X-rays via the inverse Compton effect (in which optical photons and electrons interact to provide X-ray photons, as demonstrated in FIG. 2 and discussed in more detail below) has been recognized for some time. Systems employing this methodology are theoretically capable of providing a steady supply of ultrashort (e.g., less than 10 ps (picoseconds), X-ray pulse strings. However, such systems exhibit a variety of shortcomings. For example, they typically require large, expensive laser sources to produce the optical photons. Additionally, the systems are unable to adequately control the production of the X-ray pulses, so that appreciable shielding is still required, and any failure of the shielding mechanism may result in a dangerous dose of radiation to a patient. Moreover, the systems are incapable of reducing or eliminating the adverse effects of patient movement during the imaging process. In short, such systems are impractical for wide-spread, convenient use, particularly for the production of high quality, safe X-ray images.

In addition to medical imaging, a source of an intense, pulsed (<10 "ps)," hard X-rays will be of value in time-resolved structure determination in both materials science and structural biology.

What is needed, then, is a compact source of pulsed, tunable, monochromatic X-rays having the proper beam geometry, low radiation dose, and high brightness to image human beings and other materials.

SUMMARY OF THE INVENTION

The problems of prior art X-ray imaging equipment and methods are solved in the present invention of a pulsed monochromatic X-ray system. The X-ray system of the invention is an integrated unit comprised of a conventional tabletop terawatt laser delivering 10 J (joules) of energy in 10 ps at a wavelength of 1.1 microns. The output IR light beam from the laser is counter-propagated against an electron beam produced by a linear accelerator ("LINAC") with a photocathode injector and small RF accelerator and gun. X-ray photons are generated by inverse Compton scattering that occurs as a consequence of the "collision" that occurs between the electron beam and IR photons generated by the laser.

The system uses a novel pulse structure comprising, in a preferred embodiment, a single micropulse. The electron beam from an RF electron LINAC comes in bunches spaced at the RF frequency or some sub-harmonic thereof. These bunches are called microbunches. The light produced by a microbunch (and sometimes the microbunch itself) is called a micropulse. The LINAC is configured to generate an electron beam having 1nC (nanocoulomb) of charge in a microbunch having a pulse length of about 10 picoseconds or less (or an electron beam brightness of $10^{12}$ A/m$^2$—radian$^2$@ 500 A). Operating the system in such a single pulse "microbunch" mode will reduce the need for shielding so that the system can be operated in an environment that is outside of a standard accelerator vault. Accordingly, the system is fabricated in such a way as to fit into a standard sized X-ray room.

A beam alignment —sub-system is used at the IR—electron beam interaction zone and directs the X-ray beam, in a preferred embodiment, through a beryllium window and onto mosaic crystals which divert the beam into a beam transport system toward the imaging target.

The reduction in the amount of shielding required by the system facilitates a configuration in which the X-ray beam deflects off of the mosaic crystals at shallow angles, allowing production and delivery of hard X-rays in the 10 to 50 keV range at high flux (for example, $1.0\times10^{10}$ photons/pulse). These can be delivered into several adjacent patient examining rooms for use in mammography, plain films of extremities and spine, chest X-rays, abdominal films, CT of all body parts using mosaic crystal rotators, and for angiography and myelography. In addition, the system can be used for time-of flight ("TOF") imaging, phase contrast imaging and weighted sums analysis of tissues, and in radiotherapy and chemoradiotherapy by tuning to K-edges.

A novel feature of the present invention is that the user can obtain an image of human tissue in one shot having a duration of 2–10 ps. Also, because the system operates in the microbunch mode, its physical size is substantially reduced as compared to prior art systems. The reduced background radiation generated by the accelerator makes the system usable in a conventional hospital treatment area or research lab. The system is also inherently safer when running in the microbunch mode in the event of a micropulse of electrons getting out of control due to a system failure. The radiation that a patient would receive, if it were possible for them to receive the radiation from the entire electron bunch, would be about 0.4 to 4 rads, delivered to a very small area. The short pulse duration also eliminates the effects of movement by or within the subject during the imaging process.

In high flux applications, the beams can be split, up to ten times for example, allowing for ten views to be obtained simultaneously in a one-shot CT of 2–10 ps.

Because the system is tunable, an X-ray wavelength can be selected that is most suited to a specific imaging task. For example, the optimal wavelength for imaging a breast is quite different from the optimal wavelengths for imaging the chest or brain. In addition, the X-rays generated by this system are inherently of narrow bandwidth as opposed to the relatively continuous broad spectrum X-rays produced by conventional X-ray tubes. The narrow bandwidth and tunability improve tissue discrimination and allow for improvements in contrast resolution, spatial resolution, and temporal resolution for all procedures.

The system of this invention produces a small effective focal spot size. Consequently, the X-rays can be used in phase contrast imaging, which delivers 100 to 1000 times more information than is available from conventional absorption imaging. The beam geometry of this system also allows for the study of large body parts.

The system can be used with conventional X-ray detectors, such as film, charge coupled devices, and time-of-flight detectors, or with special detectors optimized for use with the characteristics of the X-ray beam and application.

The system can operate in a variety of modes, including:

Plain films, computed radiography, and direct digital radiography to obtain chest radiographs, mammograms, extremity films, spine films, and abdominal films;

Contrast enhanced studies, with K-edge imaging being feasible in both standard angiographic format and with CT techniques, thereby reducing the radiation dose to the patient and while decreasing contrast medium load;

CT and microtomography, where computed tomography yielding 3-D reconstructions of anatomy anywhere in the body, perhaps followed by microtomography of identified lesions:

Weighted sums analysis, where a lesion detected by the system can be analyzed in vivo using a weighted sums analysis of the differential absorption of an area relative to other tissues or to expected norms for that tissue, during multiple exposures made while incrementally changing the beam energy;

Time of flight (TOF) imaging, performed in 2 ps using the monochromatic X-rays generated by this system and eliminating scatter so that the dose may be reduced as compared to using monochromatic beams without TOF techniques; and Phase contrast imaging, for determining the specific gravity of tissues, detecting infection, tumors and traumatic disruption of tissue planes, and study of blood flow without use of contrast agents.

DETAILED DESCRIPTION OF THE PREFERRED EMBODIMENTS

Figure 1:
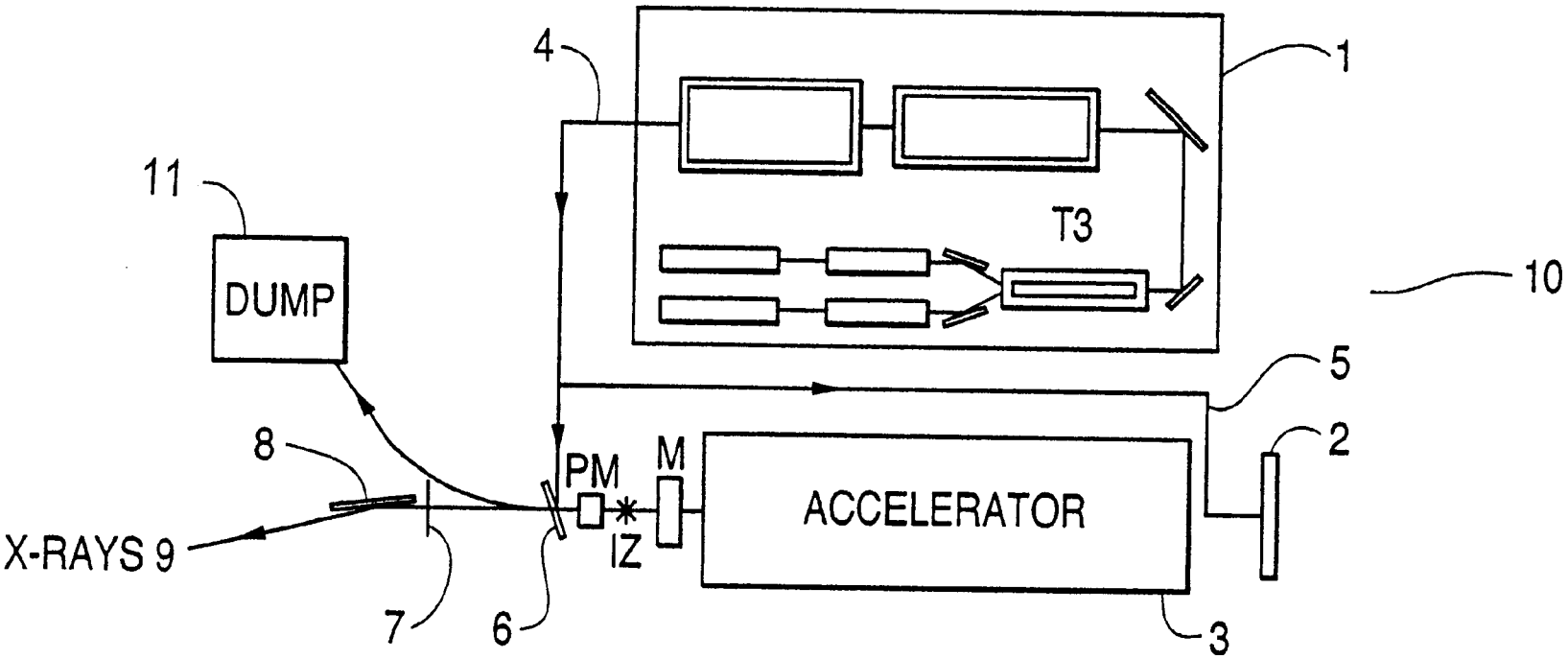
FIG. 1 is a schematic diagram of one embodiment of the X-ray system of the present invention.

The arrangement of components used in one embodiment of the system 10 is schematically illustrated in FIG. 1. A pulsed electron beam is generated by a conventional photocathode 2 and linear accelerator 3 and focused to a beam diameter of 50–200 microns using a focusing magnet M. The electron beam is then directed through an electron beam transport line into a small evacuated beam pipe containing a beam interaction zone IZ. A pulsed infrared (IR) beam 4 is simultaneously generated by a conventional tabletop laser 1 and directed into a vacuum chamber containing a beryllium mirror 6. The mirror 6 is oriented to target the IR beam directly toward the opposing electron beam so that they collide at the IZ. As the electrons collide with the IR photons, the IR photons are converted to a beam 9 of X-ray photons and leave the IZ on a path that is almost collinear with the electron beam path.

In a preferred embodiment of the system 10, the X-ray photons generated by the system 10 first pass through optional beryllium window 7 to provide a transition from the evacuated beam pipe to ambient air. The X-ray beam can then optionally be directed at an array of graphite mosaic crystals 8. For example, the X-rays can then deflect off of the crystals 8 at relatively shallow angles into a beam transport pipe, for delivery into one or more patient examining or imaging rooms (not shown). The residual portion of the electron beam is carried out of the IZ and deflected by a permanent magnet PM into a conventional electron dump 11. Because of the novel pulse structure and operational parameters of this system 10, the dump 11 will have to dissipate very little power, on the order of 0.5 W. Accordingly, the dump 11 can be a simple conductive block, a 4-inch copper cube for example, with no auxiliary cooling needed.

Figure 3:
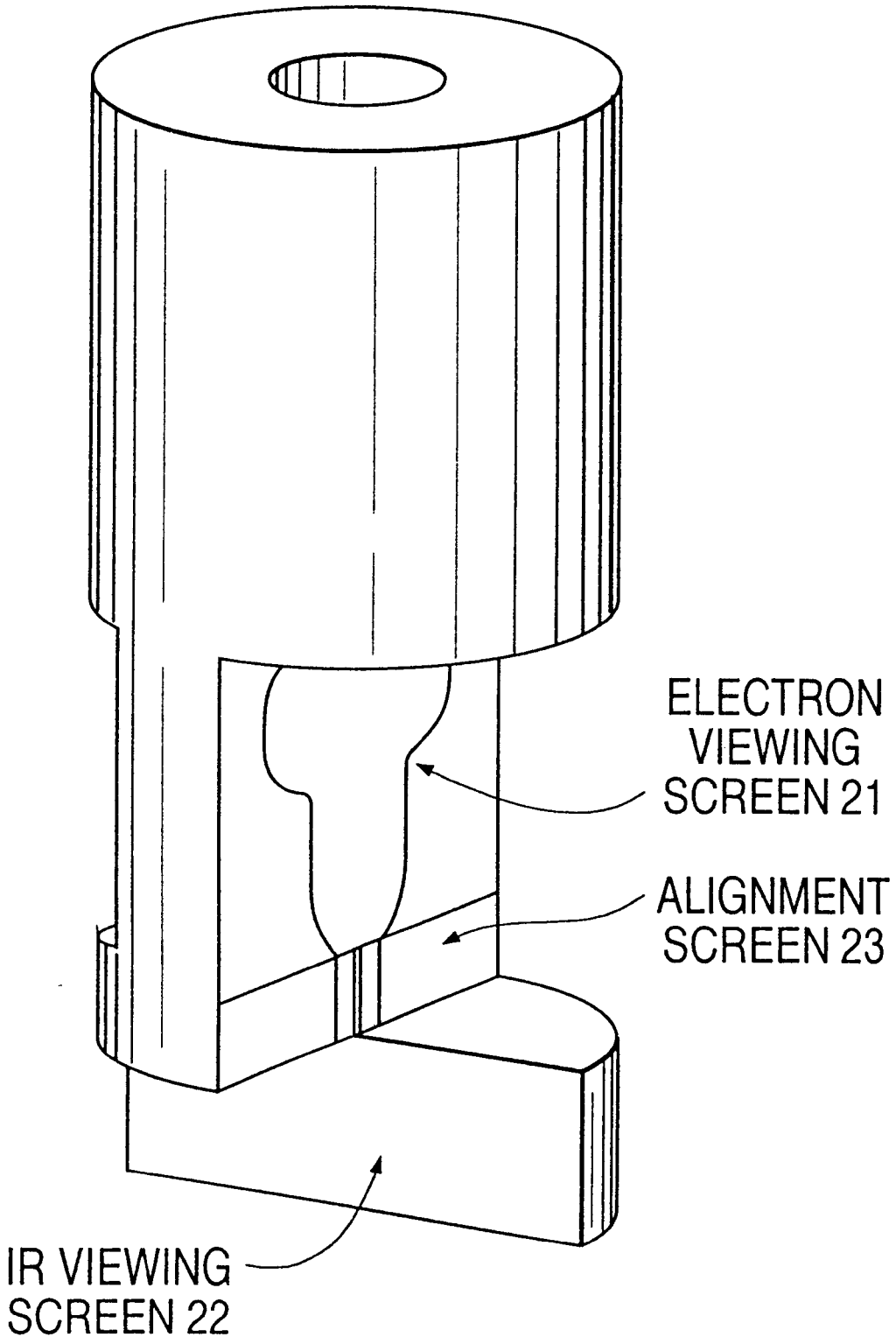
FIG. 3 is a perspective view of a beam alignment tool used in the X-ray system of this invention to align the electron and IR beams in the interaction zone during system setup and calibration.

Preferably, the diameters of the colliding IR and electron beams will be substantially equal and as small as possible, to maximize the efficiency of production of X-ray photons using inverse Comptom scattering. In this regard, it is important that the opposing IR and electron beams be carefully aligned so that they impinge directly on each other, preferably producing a beam spot size at the collision point in the IZ of 25 to 100 microns in diameter. Accordingly, the system 10 includes a beam alignment tool that is mechanically inserted into the IZ during initial setup of the system 10 and during periodic calibration. An example of such a beam alignment tool 20 is shown in FIG. 3, combining an electron beam viewing screen 21, an IR viewing screen 22, and an alignment screen 23. The beams are brought into co-alignment, first by visualization of the transition radiation produced by the electron beam hitting a beryllium electron beam viewing screen 21 and secondly by focusing the IR beam onto an aluminum IR viewing screen 22. The electron beam and IR screens 21, 22 are machined from a single aluminum plug, so that their surfaces are at 90° to one another and centered to the electron beam using actuators in the X, Y and Z directions. Both beams are observed through a common window.

Both the electron beam and IR laser source 1 are pulsed. Preferably, the IR and electron beam pulses are closely synchronized to maximize efficiency and minimize background radiation. To obtain such synchronization and accurate timing of beam arrival at the IZ, a small amount of the IR beam from the laser 1 can be diverted at 5 and directed at the photocathode 2, thus triggering the electron emission pulse simultaneously with the IR pulse generated from the laser 1. Generally, the laser source 1 should be capable of generating a 3–10 ps pulse having an energy of 1 to 10 J, with a repetition rate of 1 to 10 Hz and a spectral width of <0.5%. Such a laser may be commercially available as an Alexandrite short pulse oscillator from Light Age, Inc., of Somerset, N.J., or, with lower repetition rates, a Nd:glass laser from Positive Light of San Jose, Calif.

The electron beam source 2, 3 is adjusted to deliver 1 nC of charge in a single microbunch micropulse having a pulse length of 10 ps or less (or an electron beam brightness of $10^{12}$ A/m$^2$—radian2 @ 500 A). Again, the electron beam pulse should be specified to correspond in time and duration to the IR beam pulse. An RF LINAC could be used as the electron beam source. The LINAC should be capable of supplying a beam energy in the range of 25 to 50 MeV, and a pulse charge of greater than 1 nC at a pulse length of less than 10 ps. The emittance of the LINAC should be <3 mm-mrad (rms), with a spot size diameter of 25 to 100 microns (90%), and a pointing stability that is small compared to the spot size. Accelerators capable of meeting these requirements are available from Advanced Energy Systems. Inc. of Medford, N.Y., as well as from other sources.

Figure 4:
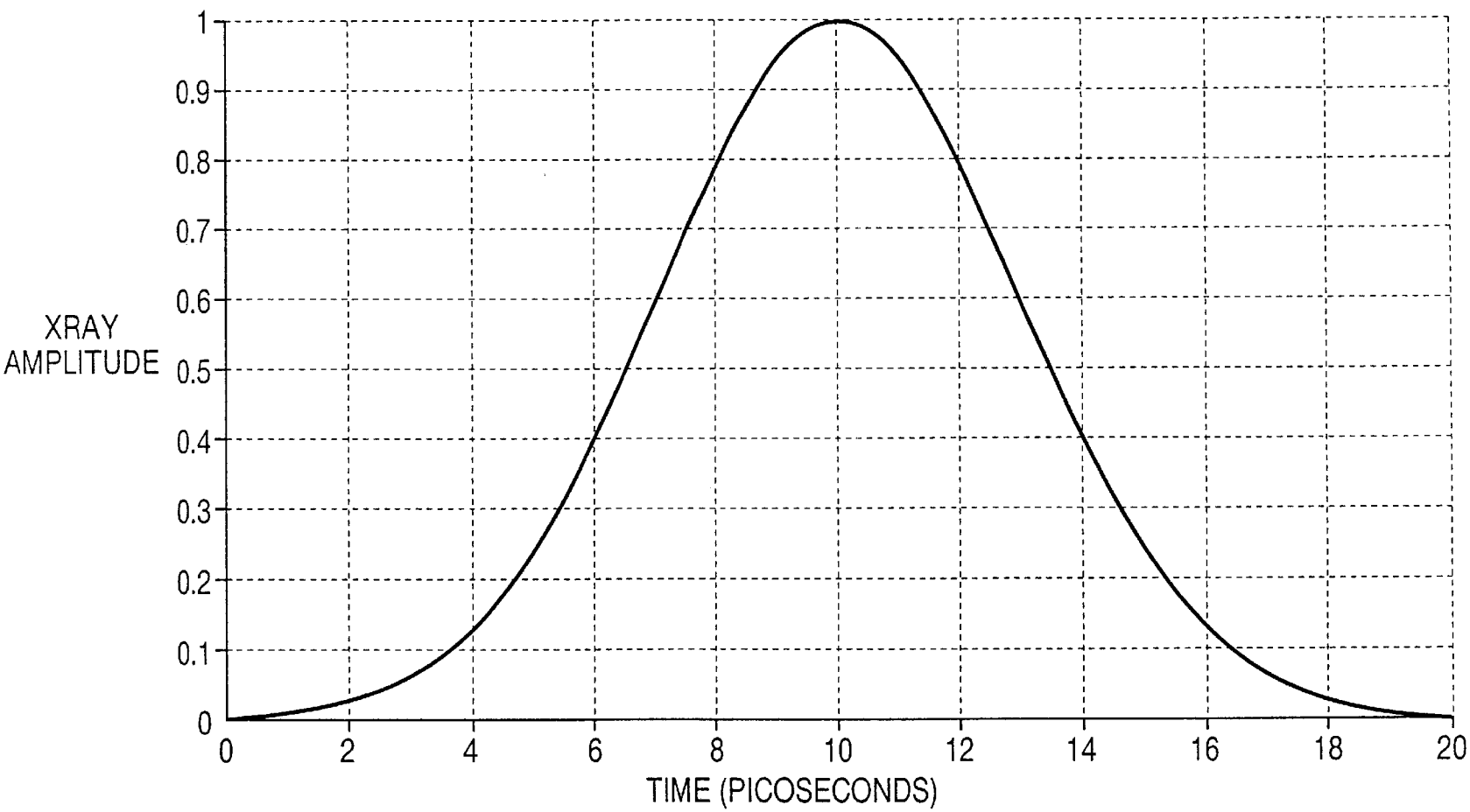
FIG. 4 is graphical representation, in the time domain, of an X-ray pulse generated by the system of this invention.

Using the system 10 as described, short pulses (1 to 10 ps) of hard X-rays in the 10 to 50 keV range at high flux ($10^9$–$10^{16}$ photons/10 ps pulse) can be produced. A time domain representation of a typical X-ray pulse generated by the system 10 is shown in FIG. 4.

Time of Flight Imaging

The fact that the X-rays of this system 10 are pulsed in bursts of a few picoseconds allows them to be used for time-of-flight (TOF) imaging,[14] where data is collected by imaging only ballistic photons up to 180 ps from the initiation of the exposure and ignoring scatter exiting over many nanoseconds. This provides an additional improvement in visibility of six to nine times, and can improve conspicuity of lesions by ten times. In particular, the pulse structure makes gated time-of-flight X-ray imaging for the reduction of scatter in thick targets very simple. With a single X-ray bunch, the system 10 can be used in conjunction with a detector which can be abruptly gated off after the early photons arrive to filter out multiply scattered photons. It is much easier to make a detector which does this (by shorting out the high voltage bias on a microchannel plate, for example) than to make a detector which needs to be gated on and off repeatedly, as would be needed from a system for which more than one bunch of X-rays are needed to make an image.

Phase Contrast Imaging

The small effective spot size of the X-ray beam produced by this system 10 enables the performance of phase ontrast imaging using information traditionally discarded in conventional imaging.[15] These improvements in imaging are not restricted to the breast but apply to any body part and to materials science as well. Beams having an energy of approximately 40–50 keV are achievable using small angles of reflection from mosaic crystals 8 and using high energy electrons. All of these techniques can be effected while reducing radiation dose to a patient and decreasing scatter due to the tunability of the beam and the limited bandwidth/narrow energy range delivered to the imaged part.

Given the low atomic weights of the major constituents of the human body, there is little difference discernible between body tissues in absorption imaging, due to exceedingly small differences in the very low absorption coefficients of these atoms. However, 100 to 1000 times as much information can be obtained by using the phase information imparted to the beam as it traverses the patient. Therefore, phase imaging can use a silicon crystal as an analyzer separating X-ray photons diffracted by density changes at tissue interfaces, differences in tissue specific gravity, and even flowing blood, from those photons not diffracted at all. Stepped, slit-scanned images can be acquired at two locations simultaneously on the surface of the same multichannel plate/CCD detector used for the TOF imaging. The part to be imaged can be stepped through the beam and an image acquired for each step. The resultant images are summated into two separate (diffracted and non-diffracted images) and then subtracted from one another for difference phase images.

Figure 2:
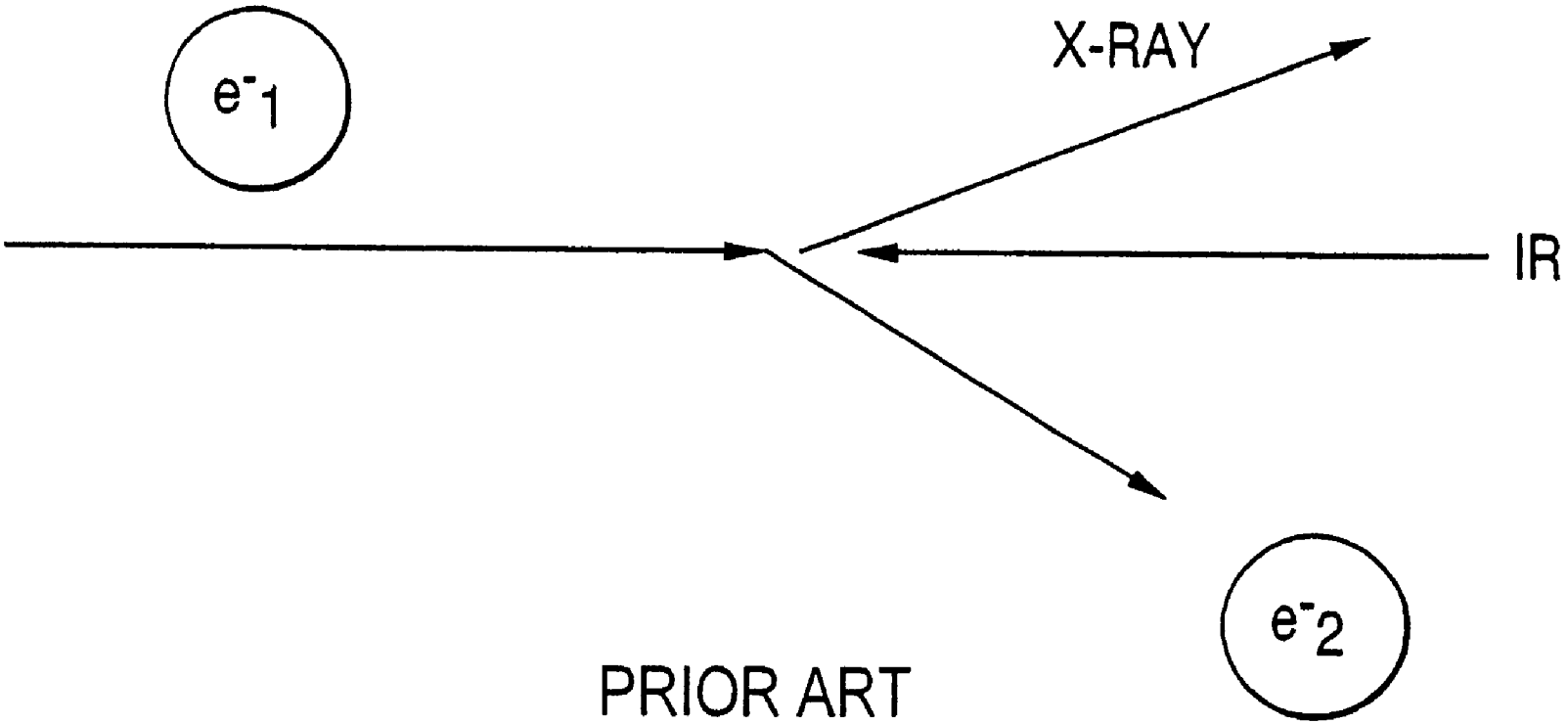
FIG. 2 is a simplified schematic representation of the production of X-ray photons using inverse Compton scattering.

The system 10 of this invention relies on inverse Compton scattering to produce the X-ray photons. The term inverse Compton scattering refers to photon scattering by an electron moving at relativistic speeds. Compton scattering is conventionally known as the process in which a photon scatters off an electron at rest, in which case the photon loses energy to the electron and its wavelength is lengthened. In inverse Compton scattering, the electron is moving and gives up energy to the photon. The basic concept of using inverse Compton scattering to produce X-ray photos is shown in FIG. 2. An incoming electron ($e^l$) from the linear accelerator "collides with" the IR photon, converting it to an X-ray photon which follows a path almost collinear with the electron beam. The relative angles of the post-collision electron beam and X-ray beam are exaggerated on FIG. 2 for clarity.

The inverse Compton scattering of a beam of low energy photons backwards by an anti-parallel beam of electrons can produce a narrow beam of high energy photons. In the case of scattering of the photon through 180°, its energy is increased by several orders of magnitude.

The production rate of X-rays by inverse Compton scattering is governed by two factors: the probability of scattering an infrared photon by an electron, which depends on the cross section, and the intensities of the two beams, which is expressed as the luminosity of the beams.

The first factor is obtained by integrating the differential cross section over the angular range of the narrow cone (−0.005 rad) containing the high energy X-rays. The general solution of the photon-electron scattering yields the Klein-Nishina formulas, which, in the case that the photon energy in the electron rest frame is small compared to that of the electron rest mass, reduce to the Thomson scattering formulas. The electron velocity is relativistic, characterized by y=85, where y is the ratio of the electron's energy to its mass.

In a system where the shortest photon wavelengths are about $2\mu$, which correspond to an energy in the labaratory rest system of 0.52 eV, the photon energy in the electron rest system is small compared to $m_e c^2$ of 0.511 MeV. The total Thomson cross section is given by $$\sigma_r = \frac{8\pi}{3} r_e^2$$

where $r_e$, is the classical electron radius.

Due to the relativistic electron motion, which has a Lorentz factor $y=E_e/m_e c^2$, the scattering angle in the electron rest frame is related to the half-angle of the X-ray cone in the laboratory frame by $\theta_s=2y\theta_c$.

The cross section for scattering into the forward cone is $$\int_{\pi}^{\pi-\theta s} \eta r_e^2 (1+\cos^2\Theta_s)\sin\Theta_s d\Theta_s$$

For a half-angle of 0.005 rad, the cross-section is 0.21 of the total Thomson cross section of 0.66 barn ($=6.6\times10^{-29}m^2$). As seen by the electron, the photon energy is increased by a factor of 2y to ~102 eV. This energy is so small compared to the electron rest mass that the Compton shift of wavelength is negligible. The photon is scattered nearly elastically through some angle $\theta_3$. Near $\theta_3=180°$ the energy of the scattered photon as seen in the laboratory system gains another factor of 2y, reaching a maximum of ~17.9 keV.

The second factor is the luminosity, which for colliding beams is $$L=N_e\times N_y\times f/_A$$

where $N_e$ is the number of electrons per micropulse, $N_y$ is the number of photons per micropulse, f the frequency of micropulses, and A the area of overlap of the two beams. The area can be calculated by integrating the product of the Gaussian distribution of the particles. If the two beams have the same size, the area is related to the width of the beams by $A=\pi(2\sigma)^2$ For different radii, the area is $$A = 1/2\eta(r_e^2 + r_y^2)$$

In a preferred embodiment of the system 10, the two beams are brought into co-alignment by an alignment tool 20 as shown in FIG. 3, first byvisualization of the transition radiation produced by the electron beam hitting a beryllium screen 21 and secondly by focusing the IR laser beam onto an aluminum screen 22. Both beams are observed through a common CaF window via a CCD TV camera with a remotely controlled and adjustable zoom/focus/iris lens. The alignment screen 23 assures centering of the device within the vacuum beamline pipe. Next the electron viewing screen 21 is used to delineate the location, size and shape of the electron beam from the transition radiation generated by the beam striking the screen. Lastly, the IR viewing screen 22 is used to steer the pointing lasers to the center of the electron beam.

An X-ray detector consisting of two thin silicon surface-barrier detectors (not shown) can be used with the system 10. The detector is placed outside of the beamline on the optical table adjacent to a 0.010 inch beryllium window used as an exit port for the X-ray beam. These detectors are used as calorimeters which are separated by an aluminum absorber. The front detector sees both the intense high energy background radiation, plus the low energy X-rays produced by the inverse Compton scattering. The rear detector sees only the high energy background. Subtraction of one signal from the other using a balanced differential amplifier chain allowed for the separation of the signals and display of the X-ray signal as a time-resolved voltage overlying the timing signals generated by the electron beam and IR beam pulses. In one embodiment, there are approximately $10^{10}$ photons/pulse.

In one embodiment of the invention, the wavelength of the X-ray pulse generated by the system 10 can be tuned by changing the energy level of the electrons emitted by the RF LINAC 3, by adjusting the RF source.

The monochromaticity and narrow divergence angle of the X-ray beam produced by this system 10 not only enables the mosaic crystals to divert the beam to an imaging laboratory or patient treatment room, but also allows the redirection of the beam in a circular fashion creating CT images using conebeam backprojection algorithms.

The time structure and the tunability make the system 10 attractive to the scientific community for exceedingly fast time-resolved studies of electronic, chemical and mechanical processes. The X-rays are not produced in a continuous spectrum, but are of very narrow bandwidth significantly reducing radiation dose to patients (from two to fifty times depending on the procedure being performed). Due to the small effective focal spot size, they can be used in phase contrast imaging, which delivers 100 to 1000 times the information than that obtained by the use of absorption imaging alone (the information used by radiologists for the last 100 years). The beam geometry is one of an area large enough to study large body parts, rather than the limited area visible at synchrotron facilities. The system is small enough to fit into a standard X-ray room and can be built to service several rooms at a time, reducing the amount of equipment needed by any radiology department.

Harmonic Generation

In another embodiment, the system 10 of this invention is also advantageous in its generation of harmonics. Referring again to FIG. 1, when the intensity of laser 1 is high enough, the number of X-ray photons generated on the second, third, and higher harmonics can become comparable to or greater than the number of photons on the fundamental. Increasing the beam intensity and/or decreasing the beam spot size at the IZ can affect the generation of harmonics to obtain a set of discrete monochromatic X-ray pulses at different energy levels. For example, for a 10 J pump laser pulse in 1 ps focused to a 20-micron diameter, the number of photons on the harmonics exceeds the number at the fundamental. The X-ray photons at the harmonics propagate in substantially the same direction as the fundamental. If the output of the laser 1 is operated to generate a pulse of 10 J in a 20 ps pulse, focused to a beam diameter of 50 microns, the number of X-ray photons on the second harmonic are approximately one percent of the number of X-ray photons on the fundamental.

The presence of harmonics in the output of system offer several possible advantages, including:

(1) Lower electron energy. For example, for 20 keV X-rays, operating on the fundamental requires the presence of 33 MeV electrons. However, operating on the third harmonic requires only 19 MeV electrons. This reduces the LIN-AC requirements and, in particular, the radiation shielding requirements. The desired harmonic could be selected at the output of the system by using a combination of conventional absorption filters and crystal reflectors (not shown).

(2) Multiple wavelengths present in the harmonics could be used to produce images at several discrete wavelengths for image processing.

(3) Multipass operation. After the laser beam has intersected the electron beam, it can be reflected with mirrors to intersect subsequent electron micropulses. These might be spaced at any subharmonic of the RF frequency of the accelerator, though several-nanosecond intervals would probably be most convenient. Multiple electron pulses could be formed by splitting the cathode drive laser pulse and delaying some pulses or by switching out several Pulses from the mode-locked oscillator/amplifier system. One pump laser pulse could be used several times, perhaps 10 times or more. Although the laser would intersect the electron beam from different directions, the X-rays would all propagate in the direction of the electron beam axis. Multipass operation would increase the total number of x-rays produced from a single laser pulse. Also, subsequent passes might be aligned at different angles to change the energy (but not the direction) of the x-rays. This might be useful for image processing, or might be used in scientific experiments to excite or probe a sample at different wavelengths at different times. The change in wavelengths could be used to separate successive x-ray pulses after they pass through the sample. Subsequent passes could be aligned to change the polarization of the x-rays. It is a unique feature of the Compton x-ray system that the x-rays are linearly polarized (or circularly polarized if the pump laser is circularly polarized). The change in polarization might have advantages for probing the system, improving images, or separating successive pulses.

Multiple Pulse Mode

In yet another embodiment. the system 10 is capable of producing two or more pulses in either closely spaced (picoseconds) or widely spaced (nanoseconds) groups. Optionally, pairs or groups of pulses can be generated to produce different X-ray energies. The system 10 can be operated in a closely-spaced, multiple pulse mode by splitting and re-combining the output of the laser 1 with a small time offset, resulting in the amplification of a pulse-pair. If this pulse pair is applied to the photocathode 2 and amplified into the interaction zone IZ, it can result in pairs of X-ray pulses separated by a few picoseconds to a few tens of picoseconds being generated. By taking advantage of the dependence of the electron beam energy on the phase of the electron bunch relative to the main radio frequency (RF) drive of the system, one could generate electron pulses of different energies which would result in X-ray pulses of different energies being produced.

To produce widely spaced pulse groups, system 10 will be capable of producing trains of pulses separated by multiples of the basic RIF period (about 340 ps in the preferred embodiment), with a resultant large increase in X-ray production within a few nanosecond burst. This mode would be useful for many applications in which the extremely fast picosecond time structure is irrelevant, and for which generating a maximum number of X-rays within a few nanosecond window is desired. This can be achieved by first splitting the output pulse from laser 1 and recombining part of it into a pulse train to be fed to the photocathode 2 drive amplifier to produce a train of electron bunches separated by a multiple of the RF period. Then the main laser pulse which is passed through the interaction zone IZ would be re-collected after each pass through brought back and refocused into the IZ and re-collided with the next pulse in the electron bunch train. This would allow the system 10 to recycle the photons from the main drive laser 1 quite a few times to produce many more X-rays (possibly more than 10 times as many) in a nanosecond burst. Further, using appropriate gated detectors with this embodiment of the system 10, freeze-frame X-ray movies of processes on the nanosecond time scale could be obtained.

Generation of Multiple X-ray Beams

Figure 5:
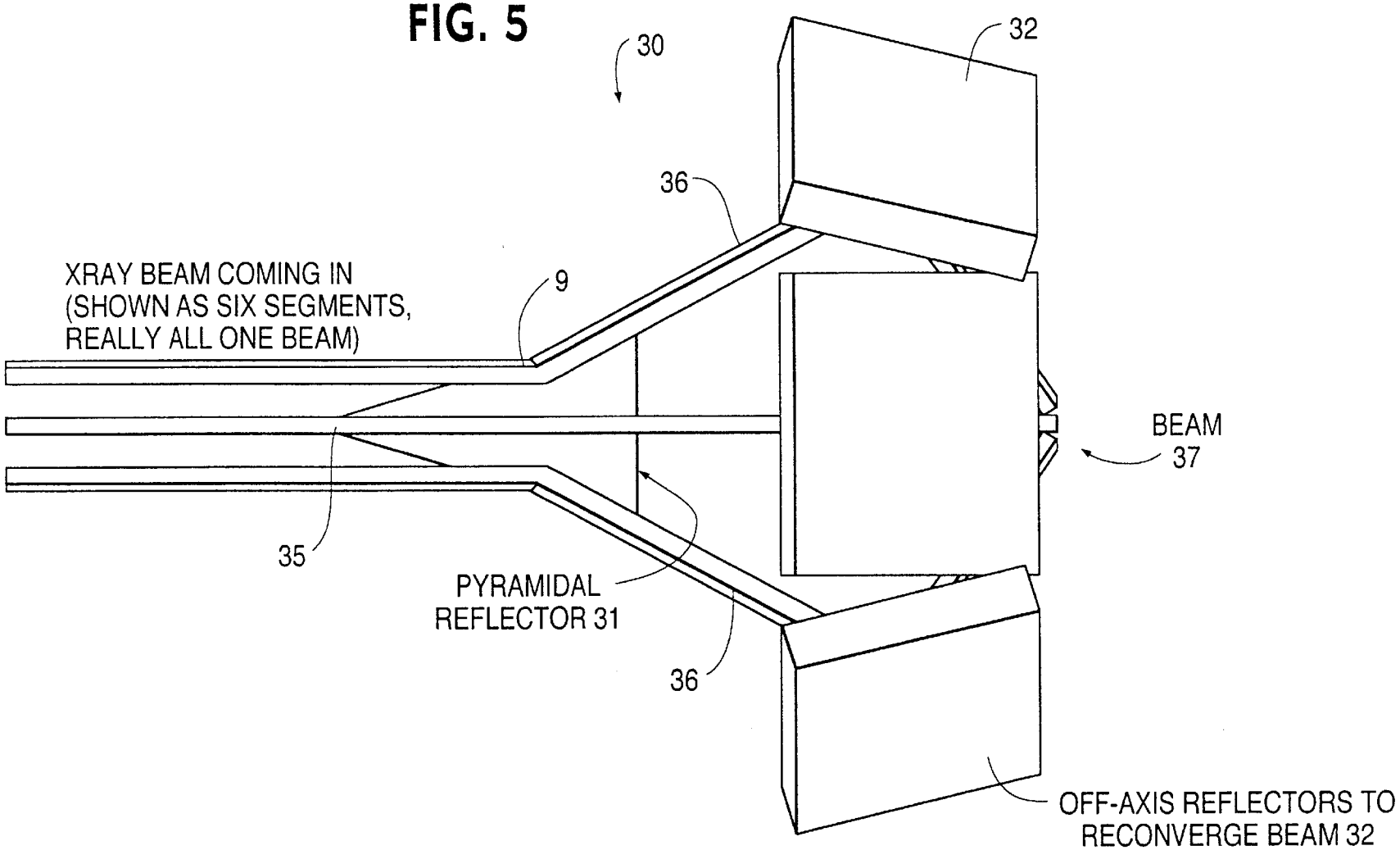
FIG. 5 is a side view of an apparatus for producing multiple X-ray beams from a single X-ray pulse generated by the system of FIG. 1.
Figure 6:
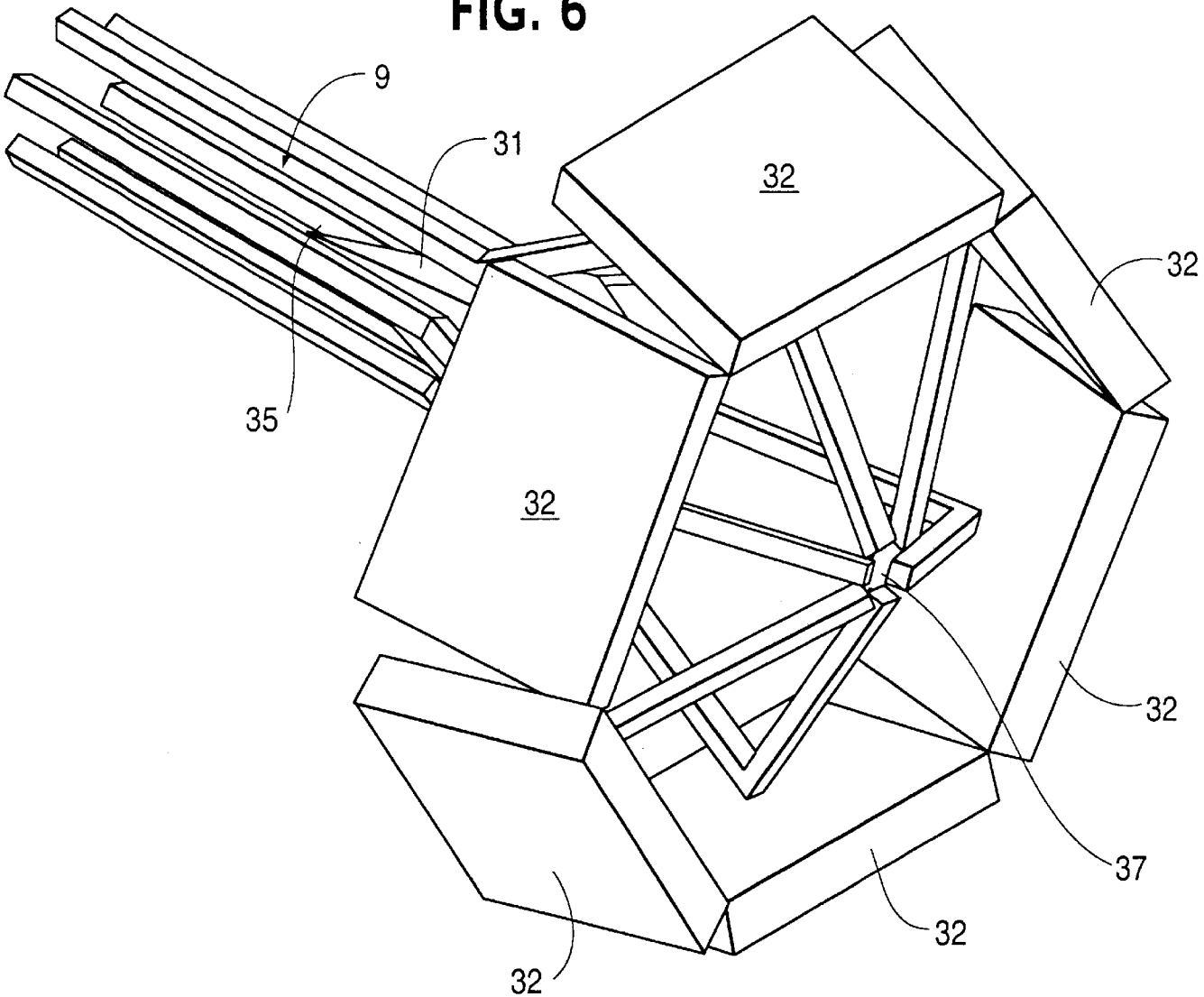
FIG. 6 is a perspective view of the apparatus of FIG. 5.

The system 10 can be used to generate multiple X-ray beams so that a single pulse will produce multiple images that would be needed, for example, for CT reconstruction. A beam reflection apparatus 30 for production of multiple beams from a single X-ray beam 9 from system 10 is shown on FIGS. 5 and 6. The incoming beam 9 is directed to a multifaceted pyramidal X-ray mirror 31 (made of either graphite crystal or a multilayer metal) having its apex 35 facing the beam 9. The mirror 31 splits the incoming beam 9 into a set of beams 36 that diverge at a small angle toward a corresponding set of off-axis reflectors 32. The split beams are then redirected at 37 back to the axis of the incoming beam 9 while crossing the original axis at different angles.

Energy Scaling

The system 10 as described can easily be scaled to produce X-rays of higher energy, while preserving the high fluxes available in the preferred embodiment. Since the energy of the emitted X-rays increases as the square of the electron beam energy (for X-ray energies much less than the electron-beam energy, i.e., less than many MeV), lengthening the LINAC will provide X-rays easily beyond the energy range used for the highest energy materials science work (a few hundred keV) and even into the gamma ray region (a few MeV) with very high fluxes. The embodiment of FIG. 1 uses a LINAC 3 approximately 2 m long, and should be able to provide X-rays beyond 60 keV. Using a 4-meter long LINAC 3, this would generate up to four times this energy, or 240 keV. Such an embodiment would result in a system 10 that is physically larger, and therefore would not be preferred for compact medical devices, but could be of benefit in materials radiography.

As referred to above, the pulsed, tunable, monochromatic X-rays of the present invention can advantageously be used in performing mammography. More specifically, the present invention can be used to perform 3-D/volumetric monochromatic mammography without the use of breast compression. Acquisition of data using a cone-beam geometry inherent in the X-ray beam of this device and either rotation of a prone patient about the central axis of the breast, or the rotation of mosaic crystals in front of the patient, can be coupled with cone-beam backprojection algorithms for volumetric reconstruction of full 3-D images. The mosaic crystal geometry is described in greater detail in U.S. patent application Ser. No. 09/290,436, which is hereby incorporated herein by reference. Other available algorithms can also be used for 3-D reconstructions with this mosaic crystal geometry.

In addition, monochromatic mammography can be combined with the administration of tumor-seeking drugs tagged with various atoms. The present invention can be tuned to the binding energy of the K shell electrons in the atom tags, thereby making the "marked" tumors more visible. The drugs can be administered either orally or intravenously. These same tumor-seeking agents can be used as an adjunct for brachytherapy treatment of invasive tumors in any body part. Once the drug has been administered, allowed to "seek" the tumor and accumulate there, it can be imaged with a beam tuned to the atom tag K-edge. Once it is located, it is additionally possible to concentrate the X-rays at that spot using X-ray optics. Thus tuned to the K-edge of the tag and made more intense by focusing, the X-rays will cause the K shell electrons to leave their orbits, in turn creating a cascade of photon emission in the atom in a very localized space of a few microns. This tends to restrict the effects predominately to the tumor itself Tumor-seeking drugs, of course, are not limited to use in breast malignancies, but can be used in colon, lung, and brain tumors, as well as other neoplasms.

Since compression of the breast will not be used for most of these examinations, breast architecture is not distorted year-to-year or examination-to-examination. Computer Assisted Diagnosis can then be implemented to better/more accurately discern changes in the breast between examinations. The lack of breast compression reduces the discomfort/pain now commonplace with performance of the procedure.

The same principles of tunability and K-edge enhancement can be used in plain film X-rays and CT examinations in the chest, extremities, bones, skull, spine, abdomen and kidneys, as well as many other objects to be imaged. Additionally, an analysis of the energies absorbed by the body and various organs at different energies imparts information as to the chemical composition of the part imaged. Since each point in an image is made up of the individual additive effects of the linear attenuations of each small volume of the tissue traversed by the beam, the final pattern of photon absorption is indicative of differing tissue makeup. This same principle can be applied to evaluating calcium deposits in the coronary arteries, carotid arteries or extremity arteries. Difference images, synthesized from images made at two or multiple different energies, will reveal much about the tissue composition. This can be done with both plain films and CTs.

Arteriography of any body part can also benefit from this K-edge imaging. X-ray contrast agents could be used in much lower doses and used intravenously instead of requiring intra-arterial catheterization for delivery. The machine can be tuned to the K-edge of the metal atoms in the X-ray "dye"; which traditionally have used iodine (the K-edge of which is 33.2 keV). Even contrast agents not traditionally used in X-ray studies may be used in place of the traditional agents, such as those used in Magnetic Resonance Imaging, which contain gadolinium. By tuning to the K-edge of gadolinium (50.2 keV), instead of tuning to 33.2 keV (for iodine) one can reduce the radiation dose to the patient even further, since the body is more transparent to 50.2 keV photons than it is at 33.2 keV. Fewer photons will stop in the patient at the higher energy, thereby reducing radiation dose. By using lower doses of intravenous contrast, "catheterless" coronary angiography is possible.

Additionally, bronchography and examination of the very small peripheral airways can be performed using radiodense gases that are inhaled. The present invention can be tuned to the K-edge of the gas, allowing evaluation of both ventilation and perfusion of the peripheral airspaces, without the need for invasive intubation. Microscopic algorithms can be used to obtain information on extremely small airways where reactive airways diseases create their undesirable effects. Using conventional imaging techniques, these airways can not be imaged using even the best-known "high resolution" modes of imaging.

The monochromaticity of the beam from the present invention, as well as its small effective focal spot size, make it extremely useful in the field of small animal imaging. Pharmaceutical firms, universities and proteomics firms can use the invention to longitudinally follow small animals over time to ascertain the long-term effects of drugs, disease states and alterations in the animals' genes. Current technology delivers extremely high radiation doses to the animal during the acquisition of microscopic detail in the live animal. This raises radiation dose levels to lethal/near-lethal levels, even with only one study. In contract, the monochromatic nature of a beam from the present invention lowers radiation dose through several mechanisms, including the absence of soft X-rays in the beam, narrow bandwidth, lack of beam hardening, and pulsed X-ray delivery (i.e., no motion artifacts).

The concept of using tumor-seeking agents applies in animals as well as humans, and can be extended to include the creation and use of other metabolically active compounds, as well as for use in gene specific sites with or without promoter and reporter genes to turn on or off some function of the cell or tissue in a telltale way.

Because of the small effective focal spot and lateral coherence of a beam produced by the present invention, such a beam is ideal for use in phase contrast imaging, as referred to above. Absorption imaging requires something dense in an object to stop photons, leaving a "shadow" on the detector. That "shadowgram" is the standard absorption image used since the discovery of X-rays. Phase contrast, on the other hand, relies upon refractive and diffractive effects within the tissues and detection of the refracted/diffracted photons. Conventionally, synchrotrons are relied upon heavily to demonstrate phase contrast images, but are large, costly, unwieldy machines for this purpose. The present invention offers a more compact, affordable, practical source for this type of imaging. Phase contrast imaging has great potential value in mammography, soft tissue imaging in trauma and in other types of imaging as well.

Because a beam produced by the present invention is so bright, tunable, and bandwidth adjustable, it is also an excellent source for use in the area of protein crystallography. "At home" (i.e., local) devices consist of a large X-ray tube emitting 8.6 keV (the Cu k $\alpha$ line), and the appropriate beamline hardware and software. However, the information gleaned from the "home" devices is limited, and full determination of a protein crystallographic structure requires data that is currently acquired at synchrotrons (which are only available at a small number of locations). The present invention is capable of performing standard crystallography, Multiple Anomalous Dispersion, and Laue diffraction, which is performed at higher energies and with multiple energies simultaneously. With this new machine, this can all be done at the "home" lab, negating the necessity for travel to a synchrotron facility, as well as offering 24/7 access, thereby speeding the processes of discovery and testing of new proteins. Of course, the machine is not limited to protein crystallography, but can also be used for crystalline diffraction as well.

Use of the present invention to perform non-destructive testing on fast moving/rotating/explosive/inaccessible objects is a natural extension of its ability to image in picoseconds. Moving turbines, rocket engines, reciprocating engines, wind tunnel targets, kinetic weapons, airline baggage and so forth are natural targets for this very rapid X-ray beam. The beam emitted from the present invention also undergoes very little divergence relative to a standard X-ray tube. Because of this, one can stand off at extended distances for imaging, by transmitting the beam through evacuated or helium filled pipes to the device/object to be imaged. The energy of this device is scalable to hundreds of keV for penetration of metal casings and thick composite structures. Studies with this machine can yield information while the imaged object is under full power/load/temperature. It can be used in both the transmission mode or by detecting backscatter from the object. It also could be useful for X-ray spectroscopy.

Figure 7:
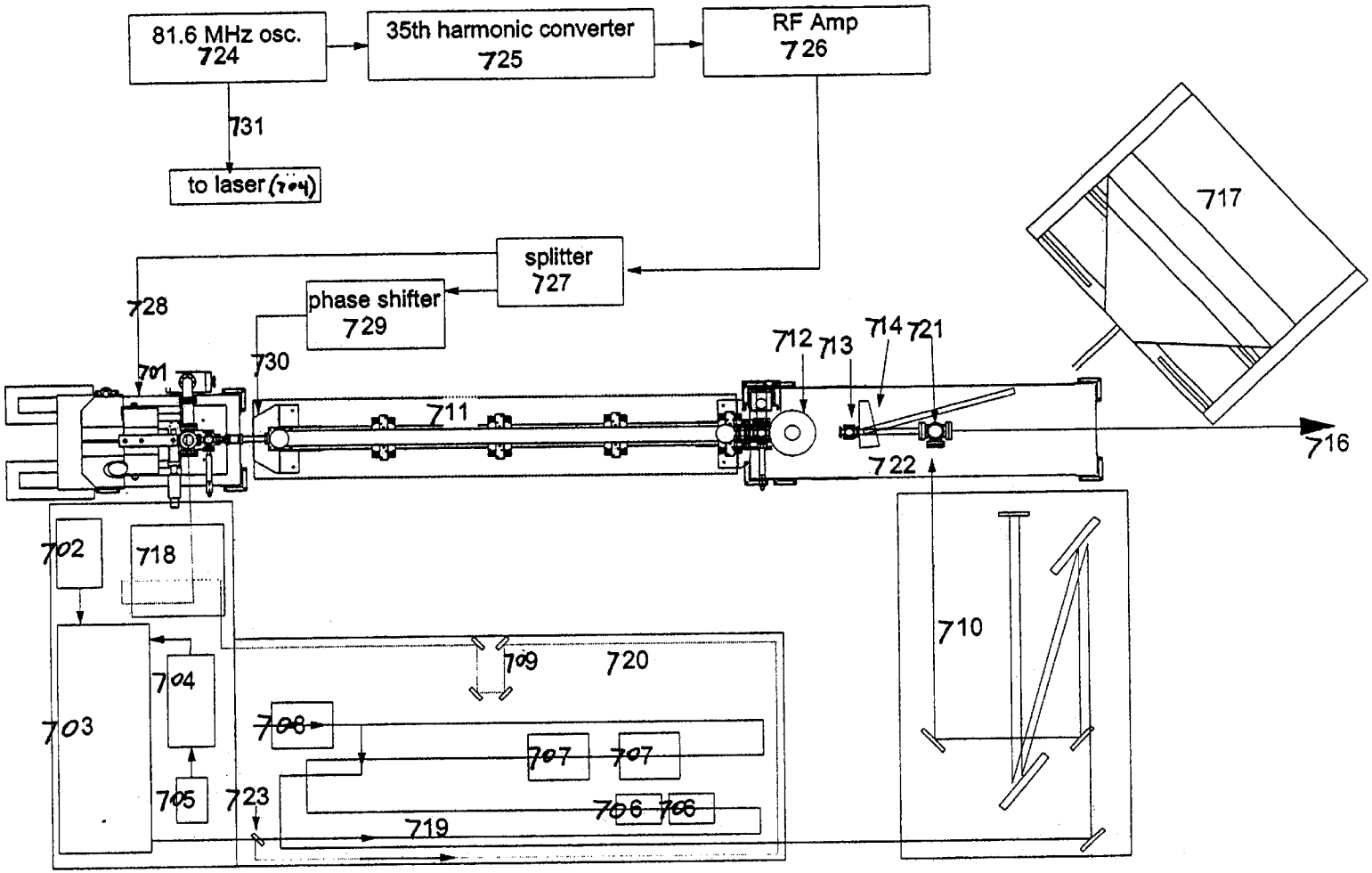
FIG. 7 provides an exemplary embodiment of the invention that is consistent with FIG. 1.

FIG. 7 provides an exemplary embodiment of the invention that is consistent with FIG. 1. In FIG. 7, a pump continuous-wave, 9.5 W pump laser 705 is shown driving a mode-locked, Ti:Saph laser 704 running at a locking frequency of 81.6 MHz and coming from the master oscillator 724. The master oscillator 724 operates at the 35th subharmonic of the RF drive for a linear accelerator 711. Laser 704 seeds the pulse-stretcher/regenerative amplifier 703, which in turn is pumped by a pulsed, Q-switched laser 702 running at 480 Hz, i.e., the 8th harmonic of the power line frequency, to which the overall pulsing of the machine of FIG. 7 is locked. The beam from the amplifier 703 is split by splitter 723 into two components 719 and 720.

Beam 719 passes through a series of progressively larger Nd:glass amplifiers 706, 707 and 708. The beam coming out of 708 is then passed to a pulse compressor 710, which reverses the effect of the stretching done in 703 to thereby produce a 10 ps pulse containing up to 10 J of energy. The beam from pulse compressor 710 is then turned into line with the electron beam from the Linac 711 by means of turning mirror 721. That beam then comes to a focus in the IZ region 713, where it collides with the electron beam to produce an X-ray pulse. Beam 720 from the splitter 723 is passed through a variable-time-delay device 709, known colloquially as a trombone. This provides the synchronization discussed above with respect to FIG. 1, whereby the electron beam and photon beam arrive at IZ 713 simultaneously. The beam from 709 is then amplified, re-compressed, and converted to the ultraviolet in the YLF laser subsystem 718, from which it goes into the electron gun 701 to drive the photocathode and create the electron beam.

The accelerator starts with the 2856 MHz drive from the 35th harmonic converter 725, which is amplified by a high-power amplifier chain 726. High-power amplifier chain 726 consists of a travelling-wave-tube (TWT) preamplifier and a modulator/klystron subsystem (not shown). The output of this chain is split by an RF power splitter 727. One of the outputs 728 of the splitter 727 is sent to the electron gun 701. The other output is passed through a phase shifter 729. The output 730 of the phase shifter is used to drive the accelerator system 711.

The electron beam from the accelerator 711 is focused by a superconducting solenoidal magnet 712 to collide with the high-power laser pulse at IZ 713. The spent electron beam is bent away from its initial trajectory by a dipole magnet 714 which directs it down a beamline toward the electron beam dump 717. Finally, the X-ray beam 716 produced at IZ 713 proceeds out of the vacuum system by passing through the beryllium mirror and window in the turning chamber 721.

Thus, although there have been described particular embodiments of the present invention, it is not intended that such references be construed as limitations upon the scope of this invention except as set forth in the following claims.

What is claimed is:

1. A system for generating an X-ray pulse, comprising:

an electron beam source configured to direct a pulse of electrons at a beam interaction zone; and a laser beam source configured to direct an optical pulse of photons at the beam interaction zone, the system configured such that when operational, the electrons in the electron pulse collide with the photons in the optical pulse at the beam interaction zone, the collision producing a pulse of approximately monochromatic X-ray photons, at least one characteristics of the pulse of approximately monochromatic X-ray photons being individually controllable.

2. The system of claim 1, wherein the pulse of approximately monochromatic X-ray photons is utilized to perform an imaging application.

3. The system of claim 2, wherein the imaging application is three-dimensional, volumetric mammography without use of breast compression.

4. The system of claim 2, wherein the pulse of X-ray photons is the only pulse of approximately monochromatic X-ray photons used to perform the imaging application.

5. The system of claim 2, wherein a drug is administered to a patient that collects on a portion of the patient to be imaged, the pulse of approximately monochromatic X-ray photons is tuned to a predetermined energy level sufficient to dislodge valence electrons from the drug, and imaging photons are produced at the portion of the patient being imaged.

6. A system for generating an X-ray pulse, comprising:

an electron beam source configured to direct a pulse of electrons at a beam interaction zone, the pulse of electrons having a predetermined electron pulse charge of at least one nanocoulomb and a predetermined electron pulse length less than approximately ten picoseconds; and a laser beam source configured to direct an optical pulse of photons at the beam interaction zone the optical pulse having a predetermined optical pulse length of less than approximately ten picoseconds and a predetermined optical pulse energy level of less than approximately ten joules, the system configured such that when operational, the electrons in the electron pulse collide with the photons in the optical pulse at the beam interaction zone, the collision producing a pulse of approximately monochromatic X-ray photons, the pulse of approximately monochromatic X-ray photons having a predetermined pulse length of less than approximately ten picoseconds and a predetermined flux of at least approximately $10^9$ photons per pulse.

7. The system of claim 6, wherein the pulse of approximately monochromatic X-ray photons is utilized to perform an imaging application.

8. The system of claim 7, wherein the imaging application is three-dimensional, volumetric mammography without use of breast compression.

9. The system of claim 7, wherein the pulse of X-ray photons is the only pulse of approximately monochromatic X-ray photons used to perform the imaging application.

10. The system of claim 7, wherein a drug is administered to a patient that collects on a portion of the patient to be imaged, pulse of approximately monochromatic X-ray photons is tuned to a predetermined energy level sufficient to dislodge valence electrons from the drug, and imaging photons are produced at the portion of the patient being imaged.

11. A method of generating an X-ray pulse comprising:

generating an individually-configured optical pulse;

generating an individually-configured electron pulse synchronously with generation of the optical pulse; and colliding the optical pulse and the electron pulse at a beam interaction zone, the collision of electrons in the electron pulse with photons in the optical pulse producing an individually-configured pulse of approximately monochromatic X-ray photons.

12. The method of claim 11, further comprising imaging a target object with the individually-configured pulse of approximately monochromatic X-ray photons.

13. The method of claim 12, wherein the individually-configured pulse of approximately monochromatic X-ray photons is the only source of X-ray photons used in performing the imaging.

14. The method of claim 11, further comprising performing three-dimensional volumetric mammography with the individually-configured pulse of approximately monochromatic X-ray photons.

15. The method of claim 11, further comprising: administering to a patient a drug having K shell electrons having a predetermined binding energy, the drug collecting at a portion of the patient to be imaged;

tuning the individually-configured pulse of X-ray photons to the predetermined binding energy of the K shell electrons;

focusing the individually-configured pulse of X-ray photons at the portion of the patient; and observing imaging photons produced at the portion of the patient by the interaction of the individually-configured pulse of approximately monochromatic X-ray photons with the K shell electrons of the drug.

16. A system for generating an X-ray pulse, comprising:

an electron source configured to direct a pulse of electrons at an interaction zone; and a photon source configured to direct a pulse of photons at the interaction zone, the system configured such that when operational, the election source is sufficiently synchronized in time and duration with the photon source to cause a collision of the pulse of electrons and the pulse of photons in the interaction zone, the collision producing the X-ray pulse.

17. The system of claim 16, wherein the X-ray pulse produced when the system is operational is an approximately monochromatic pulse of X-ray photons.

* * * * *